US005772496A

United States Patent [19]

Kurtz et al.

[11] Patent Number: 5,772,496

[45] Date of Patent: Jun. 30, 1998

[54] DEVICE AND METHOD FOR FINISHING SURFACES

[75] Inventors: Kevin Kurtz, Burlington; William Richard Kunkel, Union, both of Ky.

[73] Assignee: Enerfab, Inc., Cincinnati, Ohio

[21] Appl. No.: 813,112

[22] Filed: Mar. 7, 1997

[51] Int. Cl.[6] ..... B24B 23/00; B24B 27/08

[52] U.S. Cl. ..... 451/296; 451/350; 451/354; 451/64

[58] Field of Search ..... 451/89, 75, 296, 451/297, 310, 302, 350, 354, 355

[56] References Cited

U.S. PATENT DOCUMENTS

| | | | |
|---|---|---|---|
| 4,178,723 | 12/1979 | Fleckenstein et al. | 451/355 |
| 4,199,905 | 4/1980 | Neidigh et al. | 451/354 |
| 4,351,132 | 9/1982 | Molin | 451/354 |
| 4,392,333 | 7/1983 | Welsch | 451/355 |
| 4,583,326 | 4/1986 | Tanaka et al. | 451/241 |
| 5,042,208 | 8/1991 | Richardson | 451/354 |
| 5,240,503 | 8/1993 | Levy et al. | 451/354 |

OTHER PUBLICATIONS

"Model 55–L Dynafile" Brochure, May 1977.

*Primary Examiner*—Timothy V. Eley
*Assistant Examiner*—Derris H. Banks
*Attorney, Agent, or Firm*—Dinsmore & Shohl LLP

[57] ABSTRACT

A moveable device for finishing surfaces, in particular curved vertical surfaces. The device includes a moveable support structure for supporting a finishing apparatus, rollers and a motor for moving the device, and a finishing apparatus.

5 Claims, 5 Drawing Sheets

DEVICE AND METHOD FOR FINISHING SURFACES

TECHNICAL FIELD

This invention relates to equipment and processes for finishing surfaces, and, more specifically, to an apparatus and method for grinding, sanding, brushing, polishing, buffing, or otherwise finishing the surfaces of workpieces using a moveable finishing assembly capable of finishing curved surfaces.

BACKGROUND ART

There are a variety of manufacturing procedures that require grinding, sanding, brushing, polishing, buffing or some other type of smoothing or finishing of surfaces. For example, large sheets of metal are welded together in the manufacturing of large metal tanks and the like, such as those used in the bulk storage and processing of foods and beverages. After the weld seam is cooled it is necessary to smooth the seam surface; failure to do so can result in nicks, scratches or other rough or uneven areas on the interior walls of the tanks. These rough or uneven areas can provide a place where bacteria may establish colonies, or where food may lodge and eventually begin to decay. Rough or uneven surfaces are more difficult to clean and to disinfect than smooth ones. Also, rough or uneven areas on the interior of a tank could interfere with the ability of the tank to be drained completely and easily; when the tank is drained material may remain stuck to or lodged in these rough or uneven areas.

Current methods for finishing such seams require an attendant to hold a finishing apparatus such as a grinder, sander, polisher, or the like against a vertical wall. These finishing apparatuses can be heavy and cumbersome, and the need to stand and walk while holding them can be awkward and exhausting. This awkward and tiring method of finishing the surface can result in inconsistencies in the quality of the finishing; in particular mistakes are more likely to occur as the attendant tires.

The walls on such bulk storage tanks are generally curved. Traditional belt-type finishing apparatuses, such as the belt sanders used in sanding floors, do not perform adequately on curved surfaces. Current methods for finishing such curved walls require the use of a finishing apparatus which has small abrasive-containing flaps attached to the edge of a rotating disc. The finishing process must be interrupted frequently because these abrasive flaps wear out quickly and must be replaced often. The devices and techniques currently used result in a process that is generally time-consuming and can incur high labor and material costs.

Consequently there remains a need in the industry for an improved device and method for finishing curved surfaces without frequent interruptions and without the use of heavy, awkward, hand-held finishing apparatuses. An assembly which can support the finishing apparatus should be moveable so that it can move along the surface without interruptions in the finishing process. Such an assembly should accommodate a variety of interchangeable finishing apparatuses. Ideally such an assembly would support a finishing apparatus which is specially adapted to curved walls and will not require frequently changing of its abrasive-containing material. A moveable finishing assembly which is capable of finishing curved walls and which does not require frequently changing of its abrasive-containing material would save both time and the costs of labor and materials.

DISCLOSURE OF INVENTION

It is an object of this invention to obviate the above-described problems.

It is another object of this invention to provide a device and method for finishing surfaces.

It is yet another object of this invention to provide a device and method for finishing vertical surfaces.

It is also an object of this invention to provide a device and method for finishing curved surfaces.

It is yet another object of this invention to provide a device for finishing surfaces that can move along the surface.

It is also an object of this invention to provide a device and method for finishing surfaces in a manner that does not require a individual to hold any heavy or cumbersome finishing apparatuses.

It is yet another object of this invention to provide a device and method for finishing surfaces which produces a smooth finish free of any nicks, scratches, rough spots or the like.

It is also an object of this invention to provide a device which can be used with a variety of interchangeable finishing apparatuses.

In accordance with one aspect of the present invention there is provided a moveable device for finishing surfaces, in particular curved vertical surfaces. The device includes a moveable support structure for supporting a finishing apparatus, means for moving the device, and a finishing apparatus.

In a preferred embodiment of the present invention the finishing apparatus has a belt-like structure with either an abrasive or buffing exterior. In another preferred embodiment of the present invention the finishing apparatus has a rotary structure with either an abrasive or buffing exterior. In a more preferred embodiment the finishing assembly is capable of supporting a variety of interchangeable finishing apparatuses. In a more preferred embodiment the device is used to smooth and polish weld seams. A motor and rollers enable the device to move along the surface as the finishing apparatus grinds, sands, smooths, polishes or otherwise finishes the surface of the seam weld.

BRIEF DESCRIPTION OF THE DRAWINGS

While the specification concludes with claims particularly pointing out and distinctly claiming the present invention, it is believed the same will be better understood from the following description taken in conjunction with the accompanying drawings in which:

DETAILED DESCRIPTION OF THE INVENTION

Figure 1:
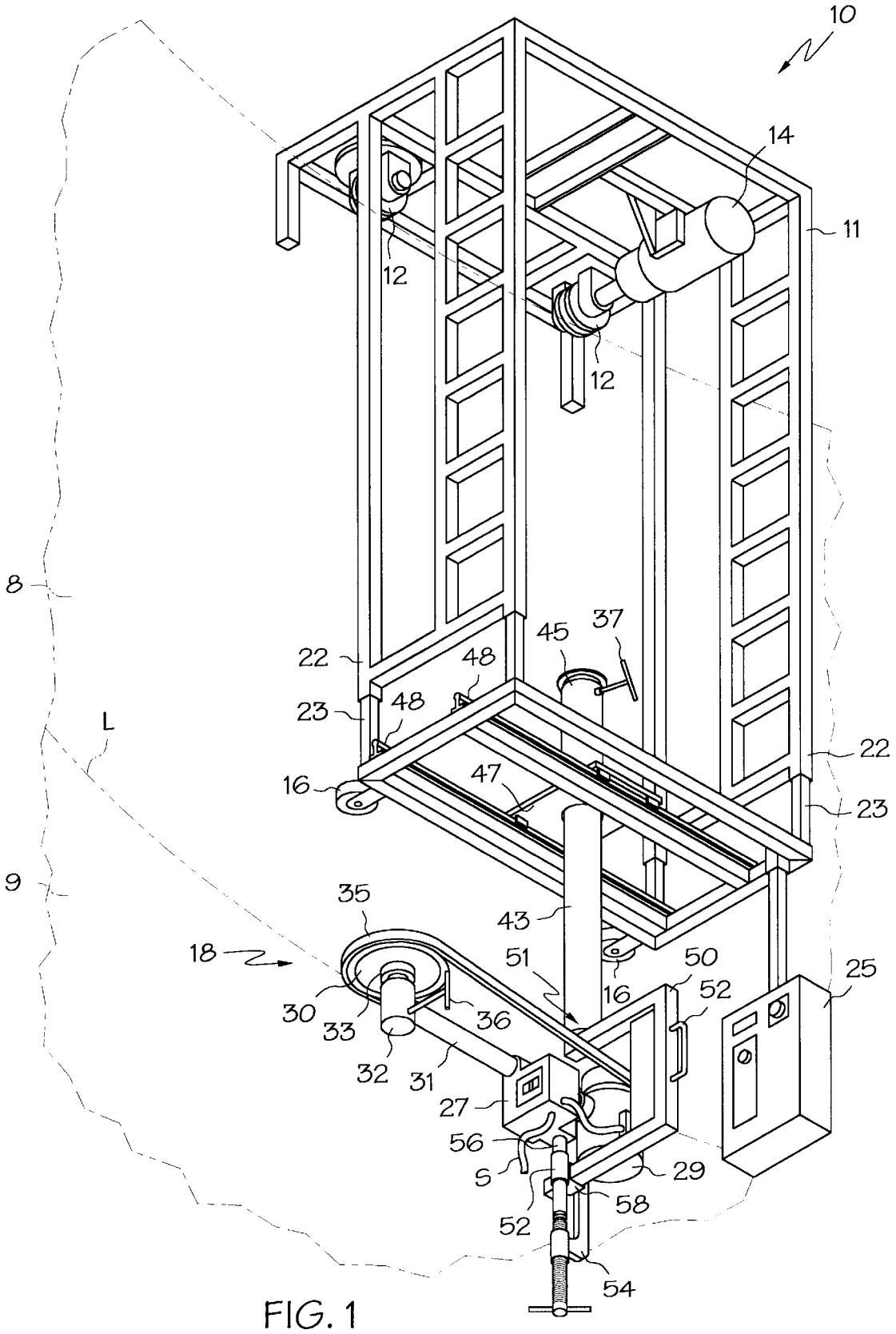
FIG. 1 is a perspective view of a finishing assembly made in accordance with the present invention and incorporating a belt-type finishing apparatus.
Figure 2:
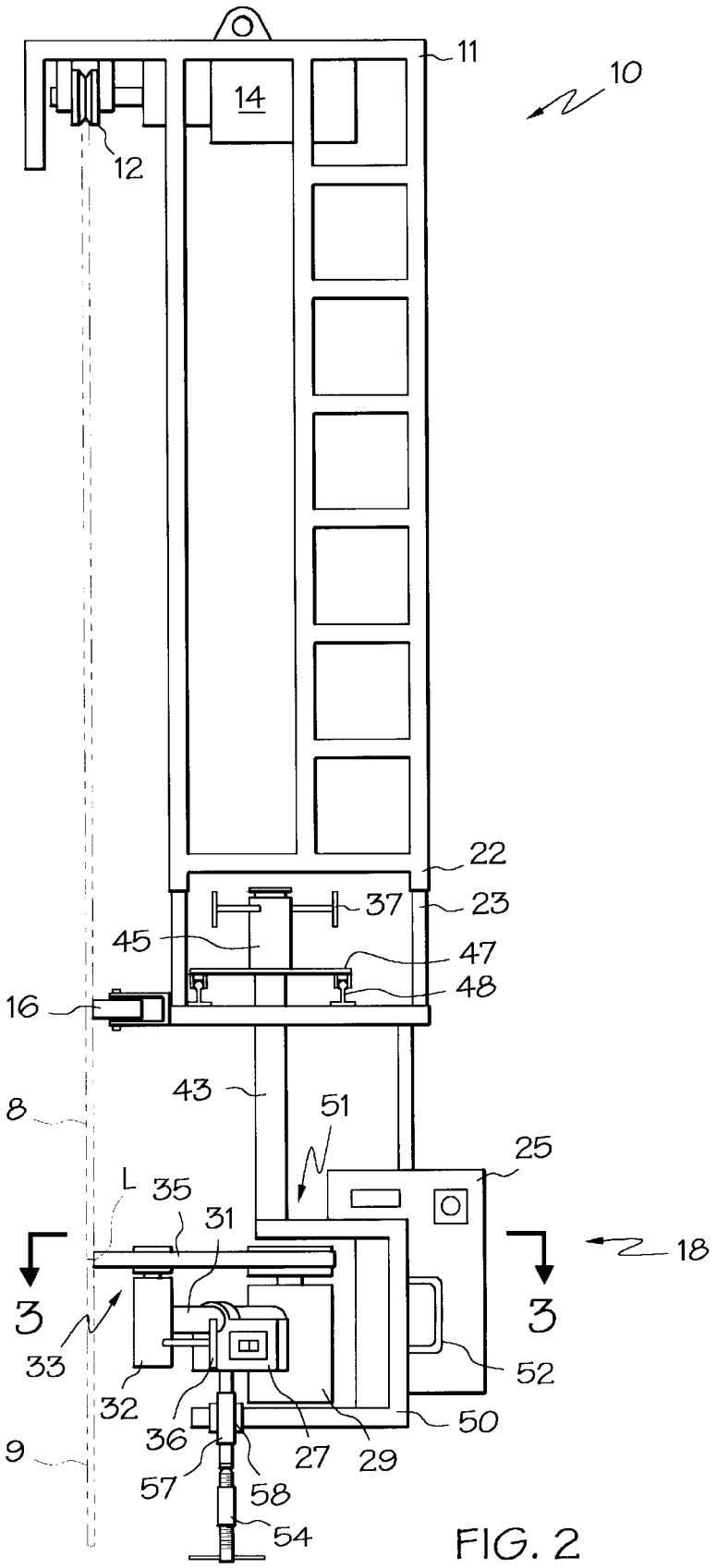
FIG. 2 is a left side view of the finishing assembly of FIG. 1.

Referring now to the drawings in detail, wherein like numerals indicate the same elements throughout the views, and wherein elements having the same final two digits (i.e., 12, 112, 212) indicate comparable elements of various preferred embodiments, FIG. 1 illustrates a preferred embodiment of a finishing assembly 10 made in accordance with the present invention. FIG. 2 illustrates a left-side view of the assembly of FIG. 1. It should be understood that the device and method described herein can be equally applicable to any variety of finishing processes such as grinding, sanding, brushing, polishing, buffing, although a grinding application has been illustrated and described for exemplary purposes.

In the preferred embodiment, the finishing assembly 10 has a frame 11. Attached to the frame is an assembly drive motor 14. Rollers 12 attached to the frame 11 are preferably designed to roll along the top of a workpiece (eg., 8), thereby allowing the finishing assembly 10 to track along the workpiece. It will be appreciated that where the workpiece is to be finished is too unstable or whether it is otherwise undesirable to support the finishing assembly 10 thereon an independent guide support (not shown) could equally be provided upon which the rollers 12 could be located. Lower support guides or wheels 16 are also preferably located on the bottom of the finishing assembly to help maintain in the assembly in general alignment with the area of the workpiece to be finished.

The finishing apparatus must align with the area of the workpiece to be finished. In this regard, the frame 11 is illustrated as further comprising means for adjusting and connecting apparatus vertically. Vertical adjustments can be provided between telescoping tubes 23, which connect to the upper telescoping tubes 22 on each side of the frame 11. For example, these telescoping tubes might contain a ball screw arrangement or connector pins which can be placed in any number of holes drilled in the tubes to enable appropriate adjustments to the resulting location of the finishing apparatus 18. Additionally, or alternately, vertical adjustments can be provided by an adjustable finishing apparatus support 43, which passes through a housing 45 and can be adjusted by means of a set pin 37.

As illustrated in FIG. 1, the housing 45 rest upon a housing supporting platform 47. The housing support platform 47 is located on top of tracks 48, which allow the entire finishing apparatus 18 and finishing apparatus support 43 to be moved back and forth along the tracks 48. A rotational connection (bearings) 51 allows for additional alignment of the finishing apparatus 18. Handles on the finishing apparatus 36,52 facilitate in the placement and alignment of the finishing apparatus 18.

Connected to the frame 11 of the finishing assembly 10 is an assembly control unit 25. The speed at which the finishing assembly moves along the workpiece can be modified to accommodate a variety of finishing applications and environments.

Figure 4:
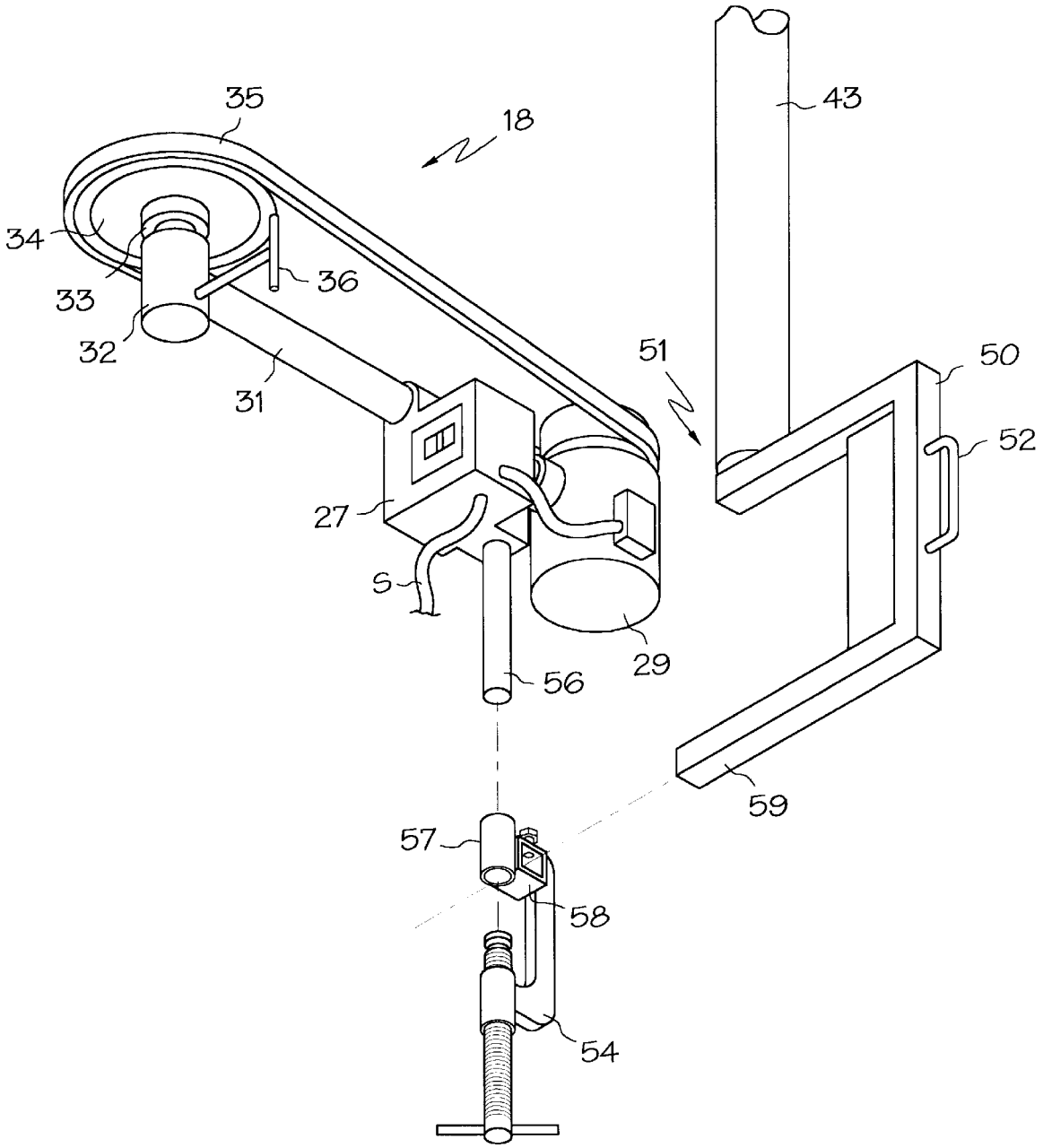
FIG. 4 in a partial exploded view of the belt-type finishing apparatus of FIG. 3.

FIG. 1 illustrates a preferred embodiment wherein a belt-type finishing apparatus 18 is used to smooth a seam line L between two workpieces 8,9. FIG. 1 illustrates a preferred embodiment using a belt-type finishing apparatus 18. As best seen in FIG. 4, a partial exploded view of the belt-type finishing apparatus 18, the apparatus consists of a belt-like structure 35, which contains an abrasive or buffing surface. The apparatus includes a finishing apparatus drive motor 29 and a finishing apparatus control unit 27. The finishing apparatus control unit 27 is connected to a source of power (e.g., electrical) S. The finishing apparatus drive motor 29 is connected to one end of a lateral support 31. Connected to the other end of the lateral support 31 is a housing 32 containing a shaft 33 which is connected to a rotating disc 34. The belt 35 stretches between the disc 34 and the drive motor 29.

Figure 3:
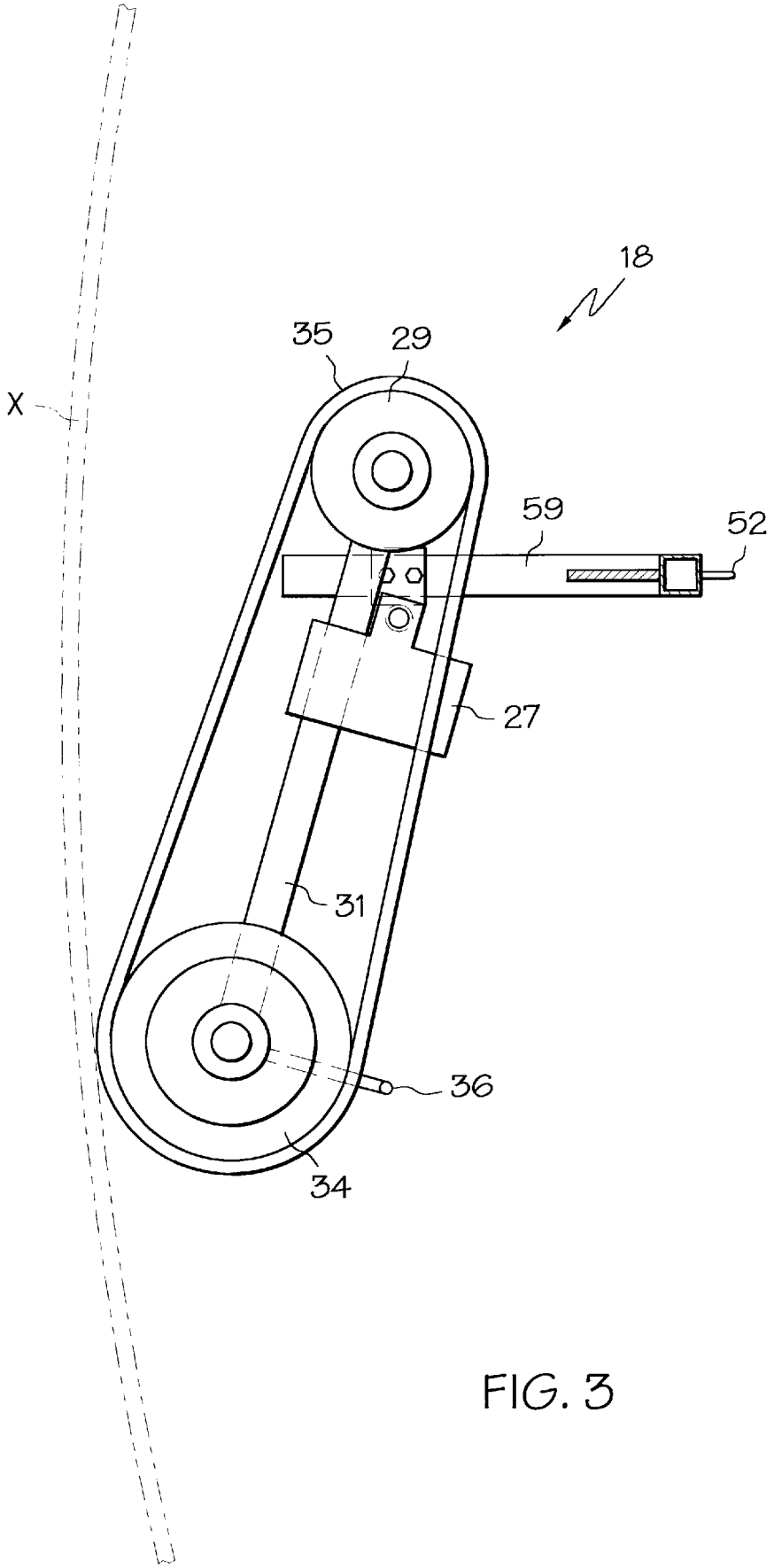
FIG. 3 is a partial cross-sectional view, such as taken along the line 3—3 of FIG. 2, of the belt-type finishing apparatus.

FIG. 3 is a partial cross-sectional view of a preferred embodiment, such as taken along line 3—3 of FIG. 2. FIG. 3 shows the location of the belt-type finishing apparatus 18 relative to the cross section of the workpiece to be finished X. The belt 35 is placed around the rotating disc 34 and the finishing apparatus drive motor 29. As the disc 34 passes along the surface to be finished, the abrasive surface of the belt 35 smooths the surface. As seen in FIG. 3, the curved edge of the rotating disc 34 presses the outer periphery of the belt 35 against the curved surface of the workpiece.

As illustrated in FIG. 4, the surface finishing apparatus 18 has a lower apparatus support 56. This apparatus support fits into a support mount 57 located on a clamp 54. The clamp 54 also contains a bracket mount 58. A bracket 50 is connected to the finishing apparatus support 43 by means of a rotational connection 51. This bracket 50 has a lower traverse leg 59. The lower traverse leg of the bracket 59 fits into the bracket mount 58 of the clamp 54. The adjustment of the lower traverse leg of the bracket 59 within the bracket support 58 and of the lower apparatus support 56 within the support mount 57, allow for further adjustments and alignments of the finishing apparatus relative to the surface to be finished.

Figure 5:
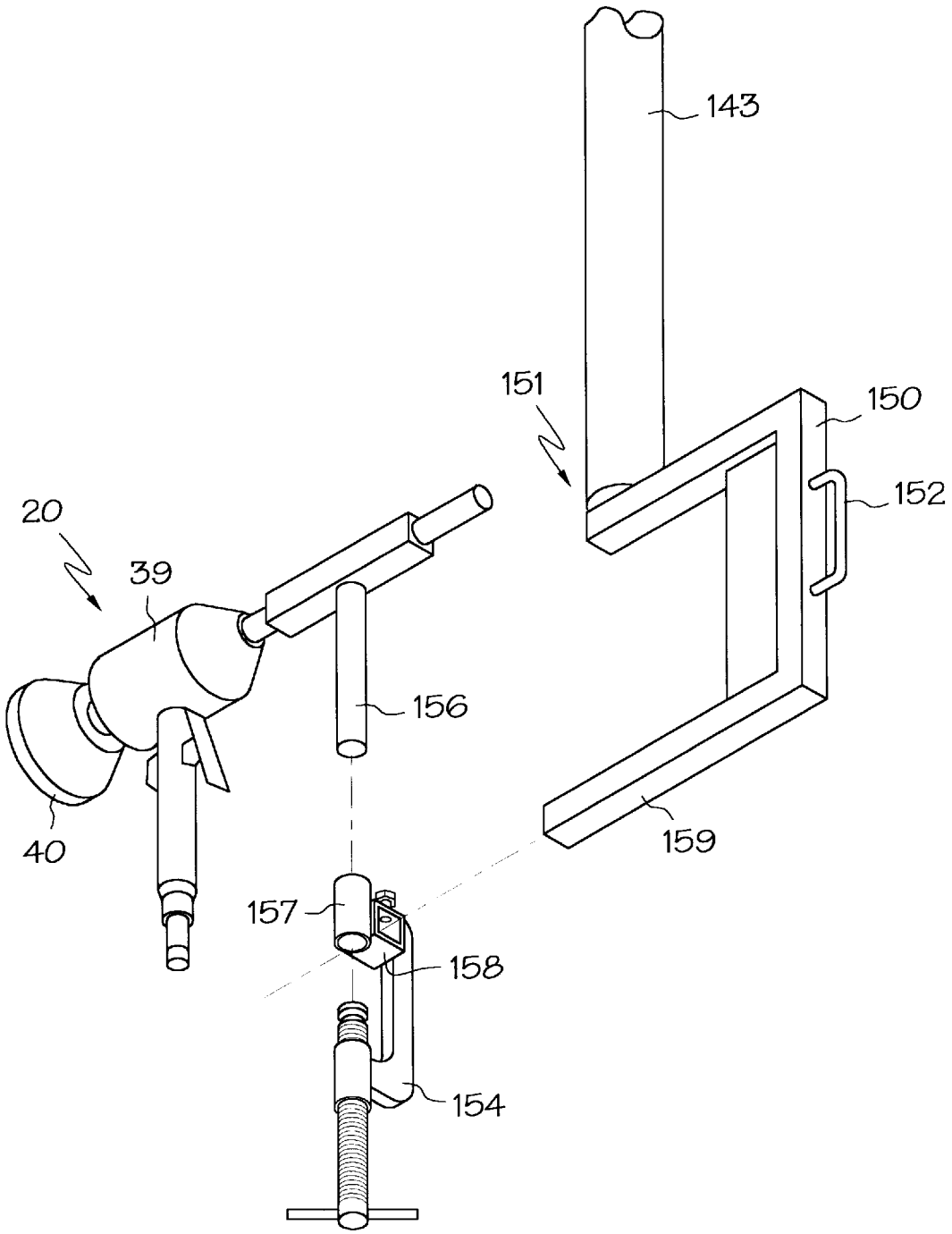
FIG. 5 is a partial exploded view of a circular-type finishing apparatus.

FIG. 5 shows another preferred embodiment. This embodiment utilizes a circular-type finishing apparatus 20. The circular-type finishing apparatus 20 includes a finishing apparatus drive motor 39 and a circular finishing surface 40. This finishing surface can have an abrasive or buffing exterior. As with the belt-type finishing apparatus 18, the circular finishing apparatus 20 has a lower apparatus support 156 which fits into a support mount 157. The bracket 150 has a lower traverse leg 159 which fits into a bracket mount 158 in the clamp 154. As with the belt-tight finishing apparatus, adjustments can be made using the telescoping tubes 22, 23, adjusting the height of the finishing apparatus support 43, adjusting the angle using the rotational connection 151, or adjusting the position of the lower traverse leg 159 relative to the bracket mount 158, or adjusting the lower apparatus support 156, relative to the support mount 157.

Before the finishing procedure, which in this preferred embodiment is smoothing of a seam weld through grinding, can be started, the finishing apparatus must be aligned with the area to be finished. If the workpiece to be finished is sufficiently stable, the finishing assembly frame 11 can be placed directly on the upper edge of the workpiece 8, such that rollers 12 are able to roll along the top of the workpiece, thereby allowing the finishing assembly to track along the workpiece. Temporary bracing may help to stabilize the workpiece. Alternatively, if the workpiece to be finished is too unstable, an independent guide support or frame upon which the finishing assembly 10 may be placed, can be provided.

As mentioned, the finishing apparatus 18 must generally align with the area to be finished. As illustrated in the preferred embodiment FIG. 1, a belt-tight finishing apparatus 18 is aligned with a seam weld L between two workpieces 8, 9. After the finished assembly 10 is in place, height adjustment can be made through the telescoping tubes 22, 23 or through adjustment of the finishing apparatus support 43. Rotational adjustments can be provided through the rotational connection 51.

Additional fine adjustments can be made through adjusting the position of the lower apparatus support 56 within its support mount 57, or adjusting the position of the finishing apparatus 18 relative to the finishing apparatus support 53 by adjusting the position of the clamp 54, relative to the lower traverse leg of the bracket 59, as it is placed through the bracket mount 58. After the finishing assembly 10 is in place and the abrasive surface of the belt 35 of the finishing apparatus 18 is aligned with the area to be finished L, the finishing process, in this case, grinding, can be started.

An attendant can control the speed at which the finishing assembly 10 travels along the workpiece 8 through means of the assembly control unit 25. The attendant can also control the finishing apparatus through the finishing apparatus control unit 27. As the Finishing assembly 10 tracks along the top of the workpiece 8, the abrasive surface of the belt 35 on the finishing apparatus 18 will smooth the surface of the weld seam L. If desired, the attendant can exchange the belt-tight finishing apparatus 18 for the circular type finishing apparatus 20. Since both the belt-tight apparatus and the circular-type apparatus have comparable lower apparatus supports, 56,156 either will fit into the support mount 57,157 of the clamp 54,154. It would be possible to first grind the weld seam using a belt-type apparatus in which the belt in which belt 35 has an abrasive surface and subsequently polished or buffed the seam the seam using a circular-type finishing apparatus 20, in which the finishing surface 40 has a buffing surface. After the finishing is completed, the finishing assembly 11, and any temporary bracing which were used to stabilize the workpiece prior to finishing, will be removed.

Having shown and described the preferred embodiments of the present invention, further adaptions of the finishing assembly and method described herein can be accomplished by appropriate modifications by one of ordinary skill in the art without departing from the scope of the present invention. A number of alternatives and modifications have been described herein, and others will be apparent to those skilled in the art. Accordingly, the scope of the present invention should be considered in terms of the following claims, and is understood not to be limited to the details of the structures and methods shown and described in the specification and drawings.

We claim:

1. A finishing apparatus adapted to finish the wall of an erected workpiece, comprising:

(a) a frame, the frame including upper and lower components, the lower frame component being selectively vertically movable with respect to the upper frame component;

(b) an interface member connected to the upper frame component, the interface member being operative to interface with a top surface of an erected workpiece and to support the frame alongside of a substantially vertically oriented wall of the workpiece, the interface member being operative to move the frame horizontally relative to the workpiece;

(c) a support member secured to the lower frame component;

(d) a finishing apparatus supported on the lower frame component by the support member, the finishing apparatus being operative to perform finishing work on the vertically oriented wall of the erected workpiece as the frame is supported on the workpiece and the support member being operative to vertically adjust the finishing apparatus relative to the lower frame component independently of the movement between the upper and lower frame components.

2. A finishing apparatus as recited in claim 1 wherein the interface member includes at least one roller.

3. A finishing apparatus as recited in claim 2 further including a first motor for moving the finishing apparatus horizontally with respect to the workpiece.

4. A finishing apparatus as recited in claim 3 wherein the vertical position of the finishing assembly is adjustably variable with respect to the support member.

5. A finishing apparatus as recited in claim 4 wherein the upper frame component includes a first set of tubular members and the lower frame component including a second set of tubular members, the second set of tubular members being disposed within and telescopically movable with respect to the first set of tubular members, the relative telescopic movement of the first and second sets of tubular members being operative to vary the height of the lower frame component relative to the upper frame component.

* * * * *